United States Patent [19]

Sickler

[11] 4,193,433

[45] Mar. 18, 1980

[54] NAIL HOLDING HAMMER

[76] Inventor: Jack R. Sickler, P.O. Box 20803, Pioneer Station, Billings, Mont. 59104

[21] Appl. No.: 917,304

[22] Filed: Jun. 20, 1978

[51] Int. Cl.[2] ..... B25C 1/00

[52] U.S. Cl. ..... 145/30 R

[58] Field of Search ..... 145/30 R

[56] References Cited

U.S. PATENT DOCUMENTS

| | | | |
|---|---|---|---|
| 82,621 | 9/1868 | Hubbard | 145/30 R |
| 116,553 | 7/1871 | Cheney | 145/30 R |
| 131,211 | 9/1872 | Daugherty | 145/30 R |
| 509,399 | 11/1893 | Richardson | 145/30 R |
| 937,987 | 10/1909 | Carlson | 145/30 R |
| 976,679 | 11/1910 | Morrison | 145/30 R |
| 1,137,663 | 4/1915 | Renton | 145/30 R |
| 1,209,583 | 12/1916 | Holmdahl | 145/30 R |

*Primary Examiner*—Othell M. Simpson
*Assistant Examiner*—J. T. Zatarga
*Attorney, Agent, or Firm*—Clarence A. O'Brien; Harvey B. Jacobson

[57] ABSTRACT

An impact tool of the type including an elongated handle and an elongated transverse head on one end of the handle is provided. The head includes structure on a first end portion thereof, spaced inwardly of the outermost end, defining a seat surface facing along a path extending outwardly of the first end portion of the head for abuttingly engaging the head end of the nail thereagainst. The first end portion of the head further includes structure defining, outwardly of the seat surface, a pair of opposing elongated wedge surfaces generally paralleling the handle, disposed on opposite sides of the aformentioned path and divergent and convergent, respectively, toward and away from the other end of the handle. The convergent end portions of the wedge surfaces define a crotch in which to wedgingly receive the midportion of a nail disposed along the aforementioned path and having its head seated against the seat surface. Further, the seat surface includes an outer peripheral curb portion extending therebout on three sides thereof including the side of the seat surface adjacent the other end of the handle and the two adjacent remote sides of the seat.

2 Claims, 9 Drawing Figures

NAIL HOLDING HAMMER

BACKGROUND OF THE INVENTION

Various forms of hammers have been previously provided with differently constructed and functioning nail holding features whereby the hammers, or similar tools, may be utilized to temporarily hold a nail for setting during a nailing process.

Examples of various different forms of impact tools including nail holding structures are disclosed in U.S. Pat. Nos. 569,161, 857,104, 976,679, 1,052,965, 1,103,380, 1,133,705, 1,258,053, and 3,987,828 as well as Norwegian Pat. No. 71439, dated Dec. 23, 1946.

Although the various nail holding features disclosed by the aforementioned patents are operative at least to some degree in various different environments, a need exists for an impact tool including nail holding structure with which a nail may be readily engaged and which will be capable of supporting the nail engaged therewith stationary during the initial nailing stroke.

BRIEF DESCRIPTION OF THE INVENTION

The nail holding hammer of the instant invention is designed whereby various forms of nails may be conveniently held thereby, firmly, during an initial nailing stroke. Further, the hammer is also constructed in a manner whereby a nail held therefrom, after a few practice strokes by the user, may be readily disengaged from the hammer at termination of the initial nailing stroke.

The nail holding structure of the hammer is such that it may be readily incorporated into the manufacture of an otherwise conventional claw hammer as well as other different forms of hammers.

The main object of this invention is to provide a hammer with nail holding structure enabling a nail to be readily engaged with and firmly held from the hammer during an initial nailing stroke.

Another object of this invention is to provide nail holding structure which may be readily incorporated into the manufacture of different types of hammers.

Still another object of this invention is to provide nail holding structure for a hammer which will enable the nail held thereby to be readily disengaged from the hammer at termination of the initial nailing stroke.

Another important object of this invention is to provide a hammer with nail holding structure adapted to support various different forms of nails from the associated hammer.

A final object of this invention to be specifically enumerated herein is to provide a hammer with nail holding structure which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
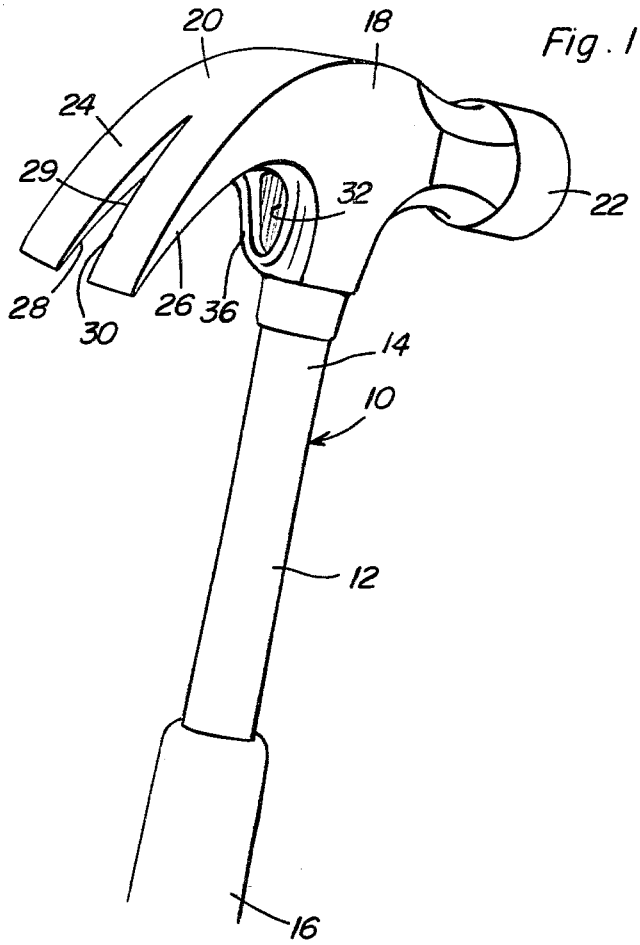
FIG. 1 is a fragmentary, perspective view of a claw hammer including nail holding structure in accordance with the present invention.

Referring now more specifically to the drawings, the numeral 10 generally designates a first form of hammer constructed in accordance with the present invention. The hammer 10 includes an elongated handle 12 having first and second end portions 14 and 16 and an elongated transverse head 18 supported from the end portion 14 of the handle 12. The head 18 includes first and second end portions 20 and 22 and it may be seen that the first end portion 20 defines a pair of curved claws 24 and 26 including elongated spaced apart wedge surfaces 28 and 30, defining a crotch 29 therebetween, which generally parallel the handle and diverge and converge, respectively, toward and away from the end 16 of the handle 12. The end portion 22 of the head defines an impact surface 31 generally paralleling the handle 12 and which may be abutted against the head of a nail during nailing strokes.

The foregoing comprises a description of a conventional claw hammer.

The hammer 10 includes, however, a seat surface 32 on the end portion 20 inwardly of the terminal end thereof and facing in a direction opposite to the direction in which the surface 30 faces and along a path disposed at substantially right angles to the handle 12. The path along which the surface 32 faces extends between the wedge surfaces 28 and 30 at a point spaced from their convergent ends. The aforementioned path extends between the wedge surfaces 28 and 30 at a position therealong in which the surfaces 28 and 30 are spaced apart a distance to wedgingly receive the midportion of a nail therebetween. Further, the head 18 includes a curb 36 extending about the periphery of the surface 32 on three adjacent sides thereof including the side of the surface 32 adjacent the end portion 16 of the handle and the two adjacent remote peripheral edges or sides of the seat surface 32.

Figure 2:
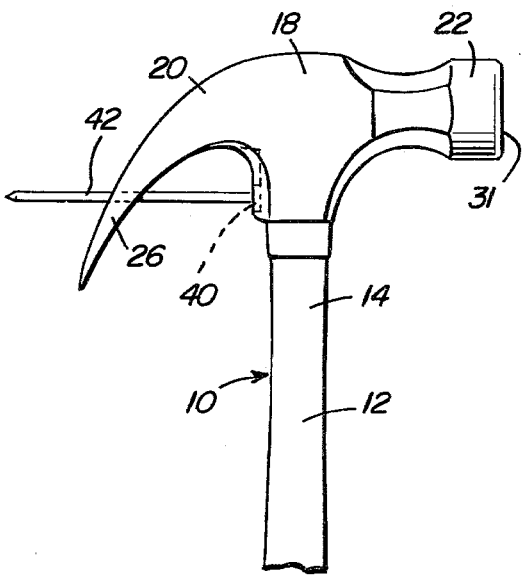
FIG. 2 is a fragmentary, side elevational view of the claw hammer illustrated in FIG. 1 and with a nail in position being supported from the nail supporting structure.
Figure 3:
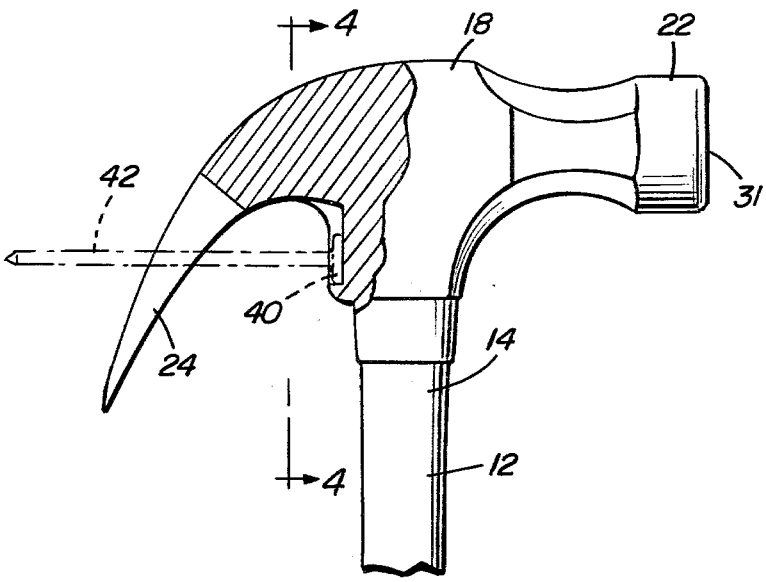
FIG. 3 is an enlarged, fragmentary, side elevational view similar to FIG. 2 but with portions of the claw hammer broken away and illustrated in vertical section.
Figure 4:
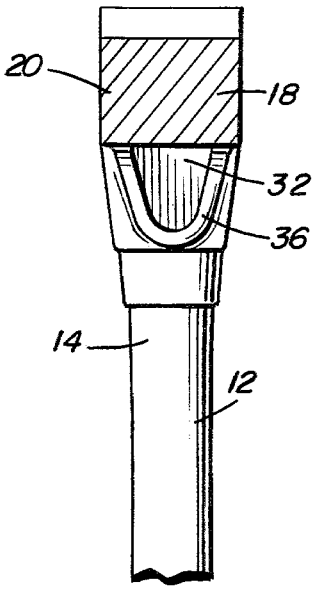
FIG. 4 is a fragmentary, vertical sectional view taken substantially upon the plane indicated by the section line 4—4 of FIG. 3.
Figure 5:
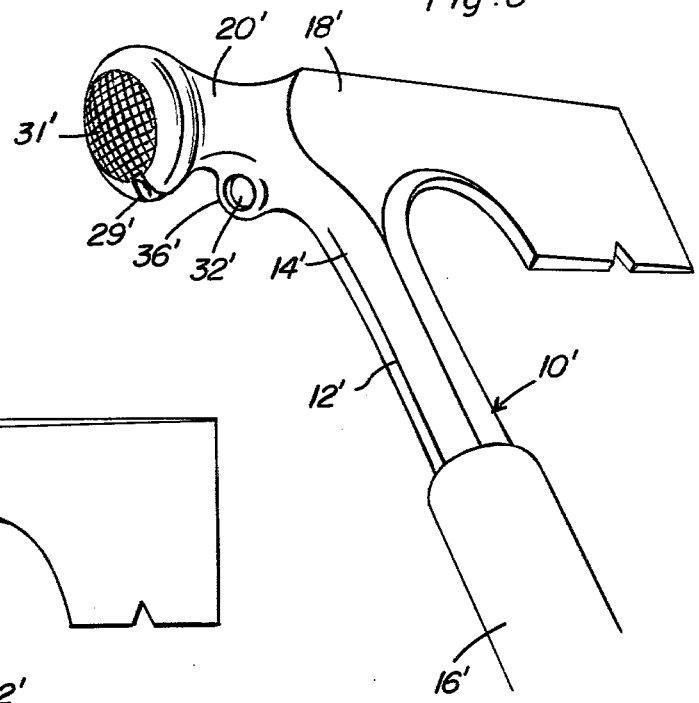
FIG. 5 is a fragmentary, perspective view of a second form of hammer incorporating nail holding structure in accordance with the present invention.
Figure 6:
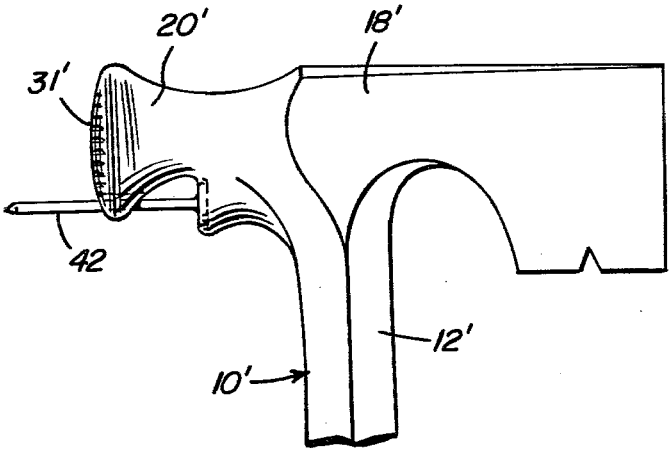
FIG. 6 is a fragmentary, side elevational view of the hammer illustrated in FIG. 5 and with a nail supported therefrom.
Figure 7:
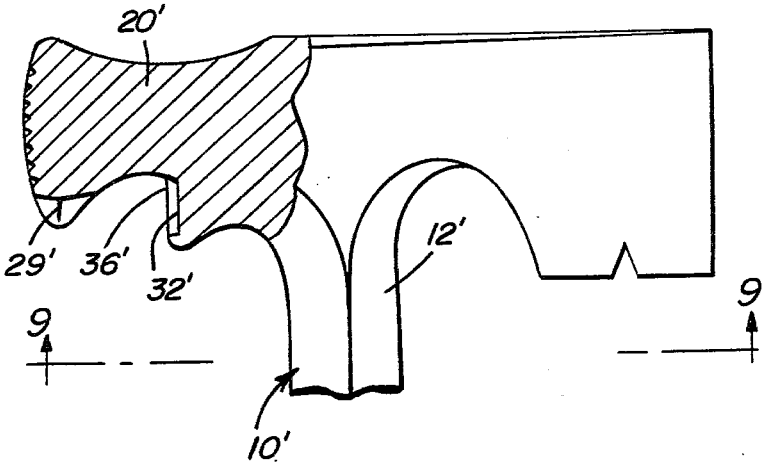
FIG. 7 is an enlarged, fragmentary, side elevational view of the second form of hammer with portions thereof being broken away and illustrated in vertical section.
Figure 8:
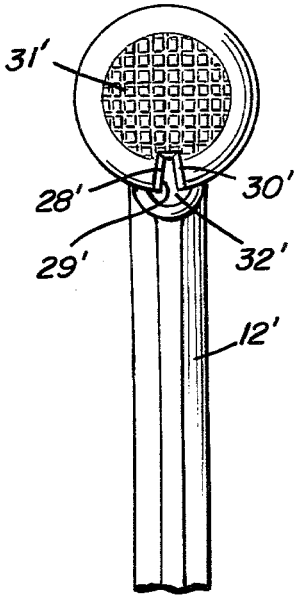
FIG. 8 is a fragmentary, elevational view of the second form of hammer as seen from the left side of FIG. 7.
Figure 9:
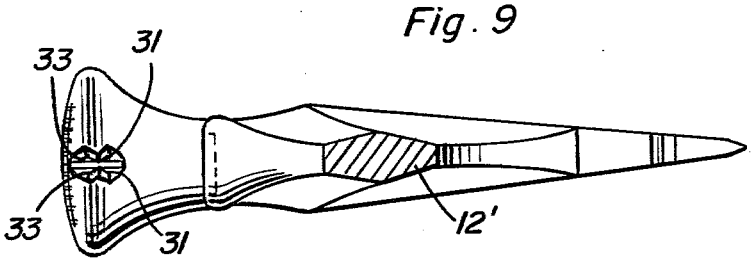
FIG. 9 is a fragmentary, sectional view taken substantially upon the plane indicated by the section line 9—9 of FIG. 7.

The inner surfaces of the curb 36 are disposed at substantially right angles relative to the seat surface 32 and it may be seen from FIGS. 2 and 3 of the drawings that the head 40 of a nail 42 may be seated against the seat surface 32 within the confines of the curb 36 and with the midportion of the nail 42 wedgingly received between the surfaces 28 and 30 and the nail 42 disposed at substantially right angles relative to the handle 12. When the nail 42 is positioned as illustrated in FIG. 2 of the drawings, it is firmly supported from the hammer 10 and extends along the aforementioned path disposed at right angles to the handle 12 and passing between the wedge surfaces 28 and 30.

The seat surface 32 substantially parallels to the handle 12 and when the head 40 of the nail 42 is received within the confines of the curb 36 against the seat surface 32 and the midportion of the nail 42 is wedgingly received between the wedge surfaces 28 and 30, the nail 42 is firmly supported from the hammer 10 and the initial nailing stroke may be readily carried out.

Because the surface 32 is generally planar and parallels the handle 12 and the inner surface portions of the curb 36 are disposed at substantially right angles to the surface 32, the head ends of many different types of nails may be seated against the surface 32 and maintained within the confines of the curb 36 while the pointed ends of those nails are swung, by lateral force applied thereto, toward positions with the midportions thereof wedged tightly between the surfaces 28 and 30. Any appreciable outward inclination of the inner surface of the curb 36 tends to cause a camming effect to occur when the above mentioned lateral force is applied to wedge the nail between the surfaces 28 and 30 and such camming action tends to unseat the nail head from the seat surface 32. Any slight unseating of the head end of the nail from the surface 32 allows at least slight rocking of the supported nail between the surfaces 28 and 30 and thus the nail to become loosened and fall from its supported position during the initial nailing stroke. In the past, this tendency for a nail to become loosened was either offset by second hand finger pressure or a short grip on the handle 12 and thumb pressure against the nail in order to maintain it in supported position during the initial nailing stroke. Of course, under such conditions, the reach of a person using the hammer is appreciably shortened. Accordingly, the seating surface 32, curb 36 and surfaces 28 and 30 coact to function in a manner insuring firm seating of the nail 42 in supported position, note that the convergent ends of the elongated surfaces 28 and 30 are inclined toward the surface 32.

At termination of the initial nailing stroke, if the hammer 10 is ever so slightly shifted in a direction extending longitudinally of the handle 12 to advance the end 14 thereof at the end of the initial nailing stroke, the nail 42 is automatically disengaged from its position wedgingly received between the surfaces 28 and 30 and the hammer head 18 may thus be readily withdrawn from the nail 42, rotated 180° about the longitudinal axis of the handle 12 during the backstroke of the hammer 10 and thus again swung forwardly to complete the nailing operation with the surface 31 abutting the head 40 of the nail 42.

With attention now invited more specifically to FIGS. 5 through 9 of the drawings, there may be seen a modified form of hammer referred to in general by the reference 10'. The hammer 10' includes various portions thereof corresponding to similar portions of the hammer 10 and which are, therefore, designated by corresponding prime reference numerals. The handle 12' of the hammer 10' includes a head 18' and the first end portion 20' of the head 18' defines an impact surface or face 31 corresponding to the surface 31. However, the peripheral portion of the end portion 20' facing toward the end portion 16' of the handle 12' has a crotch 29' formed therein corresponding to the crotch 29 defined between the surfaces 28 and 30. The opposite side edges 28' and 30' of the crotch 29' are divergent and convergent, respectively, toward and away from the end portion 16' of the handle 12' and it may be seen from FIG. 9 of the drawings that the edges 28' and 30' are oppositely beveled as at 31 and 33, see FIG. 9.

The end portion 20' of the hammer head 18' defines a seat surface 32' corresponding to the seat surface 32 and including a peripheral curb 36' corresponding to the curb 36. The seat surface 32' faces along a path extending between the edges 28' and 30' and, thus, a nail 42 may be supported from the hammer 10' in substantially the same manner in which the nail 42 may be supported from the hammer 10. Further, inasmuch as the surfaces 28' and 30' are generally straight and disposed in a plane paralleling the handle 12' and not inclined away from the surface 32' toward the convergent ends of the surfaces 28' and 30', as the pointed end of a nail having its head seated against the surface 32' is swung into position with the midportion of the nail wedged between the surfaces 28' and 30' the head end of the nail is tightly seated against the surface 32' with no camming action taking place to unseat the nail head from the surface 32'. Also, inasmuch as the face or surface 31' of the hammer 10' is formed on the same end of the head 18' carrying the seat surface 32', the hammer 10' need not be angular displaced 180° about the longitudinal axis of the handle 12' intermediate the initial and subsequent nailing stroke. Otherwise, operation of the hammer 10' is identical to the operation of the hammer 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. In combination with a claw hammer including an elongated handle and an elongated transverse head on one end of said handle with said handle projecting outwardly from one side of said head, one end of said head including an endwise outwardly facing abutment surface generally centered relative the longitudinal center axis of said head and for impacting with a nail to be driven into a workpiece, the other end of said head including endwise outwardly divergent and projecting curved claws curving outwardly from said one side of said head toward the other end of said handle and defining an inwardly tapering crotch therebetween terminating inwardly adjacent said center axis, said head also including a lateral projection extending outwardly of said one side defining a seat surface spaced inwardly of said claws, facing along a path extending outwardly of said other end of said head through said crotch and adapted to receive the head of a nail thereagainst extending along said path, said crotch being positioned relative to said path for wedgingly receiving the midportion of the shank of a nail extending along said path and having its head end seated against said seat surface, said seat surface being substantially planar and normal to said path, said head defining a substantially V-shaped curb projecting outwardly from said seat surface, bounding the latter from three adjacent sides and opening away from said other end of said handle, said curb including a rounded apex portion and inner surfaces disposed at substantially right angles to said seat surface and said curb being free of any portions thereof overlying the area of said seat surface bound by said curb which might act to "catch" on a head portion of a nail engaged with said seat surface to restrict movement of said head portion away from said seat surface after the remote end of the nail has been initially forced into a workpiece.

2. The combination of claim 1 wherein said head is free of magnetic means for magnetically attracting the midportion of a nail wedgingly disposed in said crotch.

* * * * *